US010827242B2

(12) United States Patent
Wang

(10) Patent No.: US 10,827,242 B2
(45) Date of Patent: Nov. 3, 2020

(54) SPEAKER ASSEMBLY

(71) Applicant: AAC Technologies Pte. Ltd., Singapore (SG)

(72) Inventor: Tong Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/529,825

(22) Filed: Aug. 2, 2019

(65) Prior Publication Data

US 2020/0053443 A1 Feb. 13, 2020

(30) Foreign Application Priority Data

Aug. 10, 2018 (CN) ..... 2018 2 1302602 U

(51) Int. Cl.
*H04R 1/02* (2006.01)
*H04R 9/02* (2006.01)
*H04R 9/06* (2006.01)

(52) U.S. Cl.
CPC ..... *H04R 1/025* (2013.01); *H04R 1/023* (2013.01); *H04R 9/025* (2013.01); *H04R 9/06* (2013.01); *H04R 1/02* (2013.01); *H04R 2499/11* (2013.01)

(58) Field of Classification Search
CPC ..... H04R 1/025; H04R 1/023; H04R 9/025; H04R 9/06; H04R 2499/11; H04R 1/02
USPC ..... 381/322, 391
See application file for complete search history.

(56) References Cited

U.S. PATENT DOCUMENTS

2009/0245565 A1* 10/2009 Mittleman ..... H04R 1/28 381/365
2016/0088385 A1* 3/2016 Fan ..... H04R 1/02 381/352

* cited by examiner

*Primary Examiner* — Vivian C Chin
*Assistant Examiner* — Douglas J Suthers
(74) *Attorney, Agent, or Firm* — W&G Law Group LLP

(57) ABSTRACT

A speaker assembly, includes: a housing with an accommodation space; a sound generator, and a sound aperture communicating the sound generator with an outside. A dustproof element is fixed by the housing and includes a first dustproof member, a pressing plate, and a second dustproof member attached to the pressing plate. The pressing plate includes a through hole aligned with the sound aperture, the through hole is completely covered by the second dustproof member. The housing includes at least two positioning protrusions located two sides of the sound aperture, and at least two melting posts extending along a protruding direction of the positioning protrusions. The pressing plate further includes two clip slots for engaging with the positioning protrusions. The positioning protrusion is located in the slip slot, and the pressing plate is fixed with the housing by the melted melting posts.

9 Claims, 2 Drawing Sheets

SPEAKER ASSEMBLY

FIELD OF THE PRESENT DISCLOSURE

The present disclosure relates to the field of electromagnetic transducers, more particularly to a speaker assembly used in a portable electronic device.

DESCRIPTION OF RELATED ART

A speaker assembly is a very important component equipped in a mobile phone for producing audible sounds. A speaker assembly generally uses a diaphragm to produce vibration and further to generate sounds.

In order to adapt to miniaturization and multifunctional development of various audio equipment and information communication equipment, the speaker assembly used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. When the speaker assembly is equipped in a mobile phone, a sound aperture of the speaker assembly should be protected by a dustproof member from outside dust. The sound aperture with the dustproof member should be assembled with the housing of the mobile phone. More and more mobile phones are using housing made of glass, which makes it difficult to assemble the speaker assembly with the housing by insert-molding process. Therefore, an improved speaker assembly is desired.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
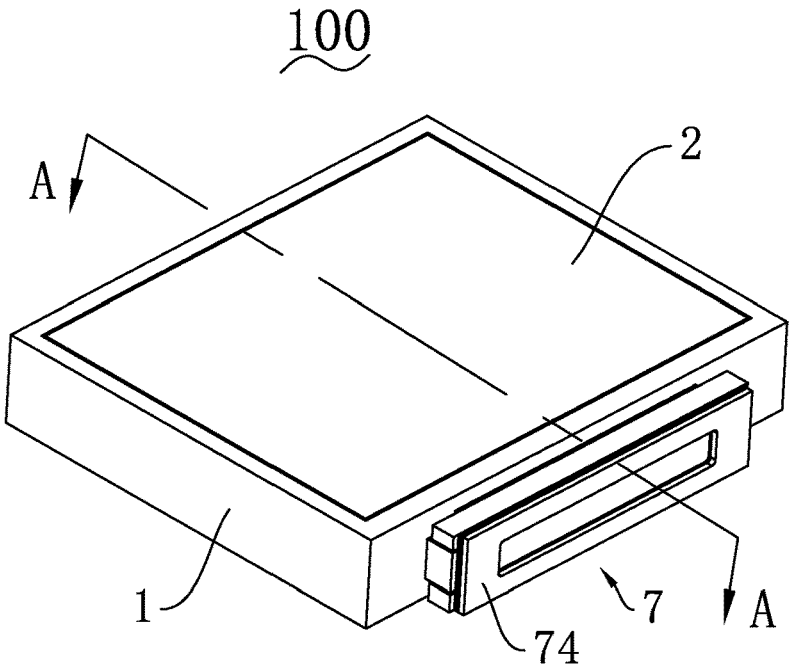
FIG. 1 is an isometric view of a speaker assembly in accordance with an exemplary embodiment of the present disclosure.

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby are only to explain the disclosure, not intended to limit the disclosure.

Referring to FIGS. 1-4, a speaker assembly 100 is disclosed by the present disclosure. The speaker assembly 100 includes an upper cover 1, a lower cover 2, a sound generator 3, a sound aperture 4, a supporting wall 5 and a dustproof element 7.

The upper cover 1 and the lower cover 2 cooperatively form an accommodation space 10.

The sound generator 3 divides the accommodation space 10 into a front sound cavity 6 and a back cavity 101. In detail, the sound generator 3 and the upper cover 1 form the front sound cavity by keeping a distance therebetween. The sound generator 3 and the upper cover 1 together with the lower cover 2 form the back cavity 101.

In the embodiment, the sound aperture 4 is formed in the upper cover 1. The upper cover 1 and the lower cover 2 cooperatively define a housing. The upper cover 1 includes a sound passageway 102 communicating the front sound cavity 6 and the sound aperture 4 for forming a side-sound structure. The back cavity is used for improving low-frequency acoustic performance.

The supporting wall 5 locates inside of the upper cover 1 and extends toward the lower cover 2. The supporting wall 5 is ring-shaped for fixing and supporting the sound generator 3. Thus, the sound generator and the upper cover 1 cooperatively form the front sound cavity 6 after the sound generator 3 is supported by the supporting wall 5.

In order to increase the stability of the supporting wall 5, in the embodiment, the supporting wall 5 is integrally formed with the upper cover 1. In the embodiment, the sound aperture 4 extends along a direction perpendicular to a vibration direction of a diaphragm of the sound generator 3.

The dustproof element 7 is configured to be a double-layer structure, and is disposed at a distal end of the sound aperture 4 for conveniently engaging with a back cover made of glass of a mobile phone, which is beneficial for positioning the double-layer dustproof element 7 to the back cover of the mobile phone even if the back cove is made of glass and insertion-molding process is not feasible.

Figure 2:
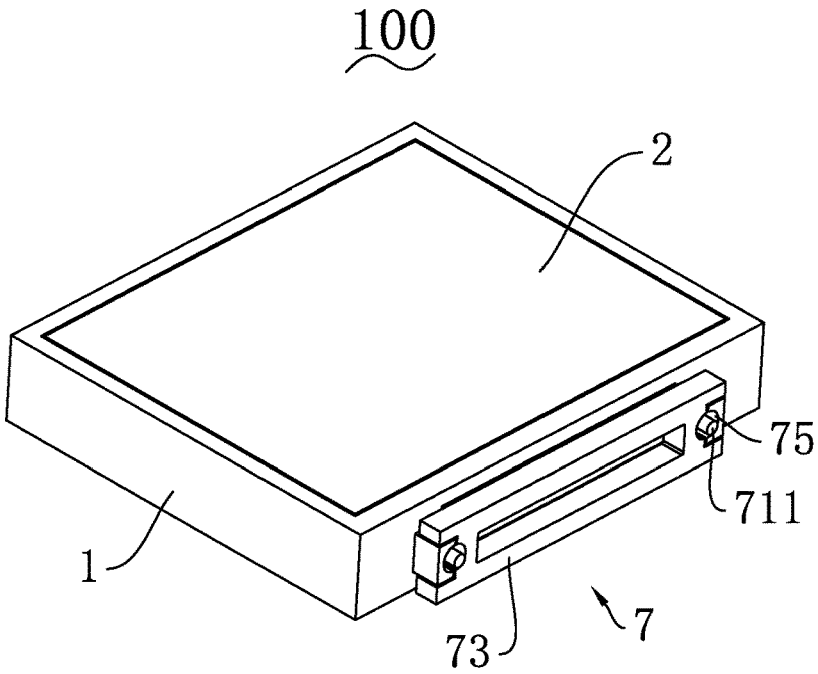
FIG. 2 is partially exploded view of the speaker assembly in FIG. 1.
Figure 3:
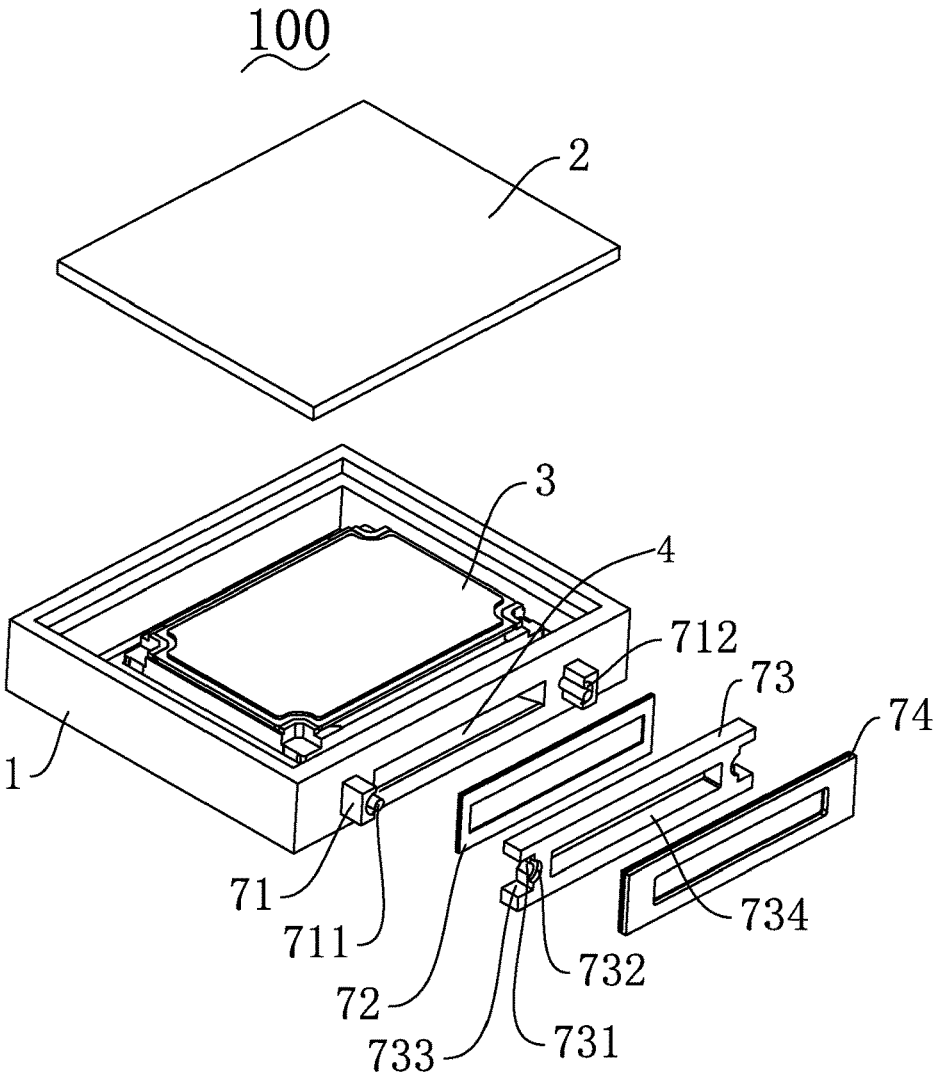
FIG. 3 is exploded view of the speaker assembly.
Figure 4:
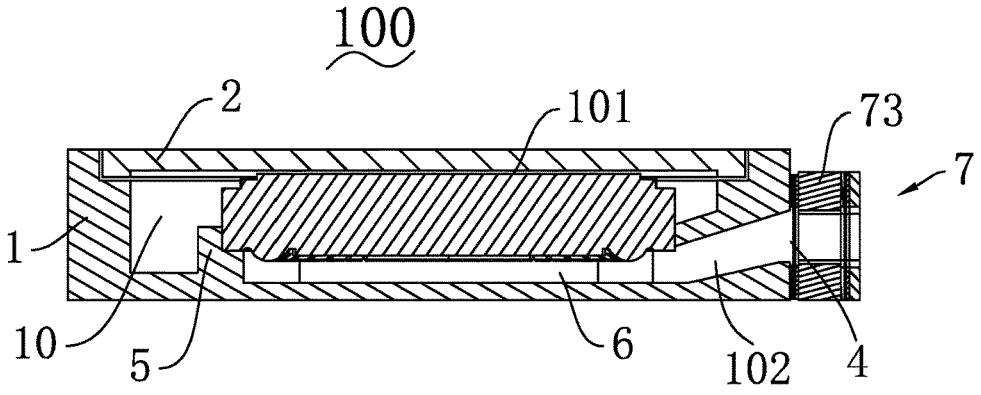
FIG. 4 is a cross-sectional view of the speaker assembly taken along line A-A.

Referring to FIGS. 2-4, the dustproof element 7 is a double-layer structure, and includes a pair of positioning protrusions 71 located two sides of the sound aperture 4, a first dustproof member 72 covering the sound aperture 4 and located between the two positioning protrusions 71, a pressing plate 73 abutting against the first dustproof member 72 and including two ends engaging with the two positioning protrusions 71, and a second dustproof member 74 abutting against an outer surface of the pressing plate 73. The protrusion 71 includes a melting post 711 located on a sidewall adjacent to the sound aperture 4 and protruding along a protruding direction of the positioning post 71. The melting post 711 includes a second recess 712 on an outer surface of a top thereof. The pressing plate 73 includes a first recess 731 located in a side facing the melting post 711 for correspondingly engaging with the melting post 711. The first recess 731 further includes a third recess 732 in a top portion thereof. The third recess 732 and the second recess 712 cooperatively form a glue-slot 75 after the top of the melting post 711 is melted.

In the embodiment, for positioning the pressing plate 73, the pressing plate 73 further includes a pair of clip slots 733 for forming a complementary structure with the positioning protrusions 71. In the embodiment, the first recess 731 locates at a bottom portion of the clip slot 733, by virtue of which the first recess 731 cooperates with a half of the melting post 711 located at a side of the positioning protrusion 71 for increasing the combination force between the pressing plate 73 and the positioning protrusion 71 after the melting post 711 is melted.

In the embodiment, the top of the melting post 711 is disposed at a middle portion of the glue-slot 75 formed by the configuration mentioned above. At the same time, the top of the melting post 711 is higher than a top surface of the positioning protrusion. When the top of the melting post 711 is melted, the glue-slot 75 is fully filled, by which the connection between the pressing plate and the positioning protrusion is much more stable. Specifically, the second dustproof member 74 is fixed by the melted glue in the glue-slot 75. The positioning protrusion 71 is integrally formed with a sidewall of the upper cover 1 by integral molding process.

In the embodiment, the first and second dustproof members 72, 74 both include dustproof meshes and frames for supporting the meshes. The pressing plate 73 includes a through hole 734 penetrating a middle portion thereof and aligned with the inside of the frame, such that the sound aperture 4 is communicated with an outside via the dustproof mesh and the through hole 734.

Compared to the related art, the configuration of the melting post 711 and the glue-slot 75 makes the double-layer dustproof element firmly be fixed at the end of the sound aperture 4, and makes it convenient to engage the dustproof element with a sound opening of the glass back cover of the mobile phone.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker assembly, including:

a housing with an accommodation space;

a sound generator in the accommodation space, the sound generator including a diaphragm;

a sound aperture communicating the sound generator with an outside;

and a dustproof element fixed on the housing and completely covering the sound aperture, the dustproof element including a first dustproof member fixed on the housing and completely covering the sound aperture, a pressing plate abutting against the first dustproof member and fixed on the housing, and a second dustproof member attached to a side of the pressing plate away from the first dustproof member; wherein the pressing plate includes a through hole penetrating therethrough and aligned with the sound aperture, the through hole completely covered by the second dustproof member;

the housing includes at least two positioning protrusions located on two sides of the sound aperture, and at least two melting posts extending along a protruding direction of the positioning protrusions;

the pressing plate further includes two clip slots recessed from two sides thereof toward the through hole for engaging with the positioning protrusions; and the positioning protrusions are located in the clip slots, and the pressing plate is fixed with the housing by the melting posts.

2. The speaker assembly as described in claim 1, wherein the pressing plate further includes two first recesses respectively recessed from the two clip slots toward the through hole, and each melting post is disposed in the corresponding first recess.

3. The speaker assembly as described in claim 1, wherein the housing includes a upper cover and a lower cover forming the accommodation space, the sound generator forms a front sound cavity with the upper cover, the upper cover forms a sound passageway communicating the front sound cavity with the sound aperture.

4. The speaker assembly as described in claim 1, wherein at the same side of the sound aperture, a top of the melting post is higher than a top of the positioning protrusion.

5. The speaker assembly as described in claim 1, wherein an outer surface of a top of each melting post includes a second recess located at a top surface of the corresponding positioning protrusion.

6. The speaker assembly as described in claim 5, wherein at each of the two sides of the sound aperture, the pressing plate includes a third recess located at a side facing the second recess and recessing toward the through hole.

7. The speaker assembly as described in claim 6, wherein at each of the two sides of the sound aperture, the second recess and the third recess cooperatively form a glue-slot for receiving a top of the melting post after the melting post is melted.

8. The speaker assembly as described in claim 7, wherein each melting post located at a middle portion of the corresponding glue-slot.

9. The speaker assembly as described in claim 1, wherein the first and second dustproof members both include dustproof meshes and frame for supporting the meshes.

* * * * *